US009041603B2

(12) United States Patent
Roper et al.

(10) Patent No.: US 9,041,603 B2
(45) Date of Patent: May 26, 2015

(54) METHOD AND APPARATUS FOR DOUBLING THE CAPACITY OF A LENS-BASED SWITCHED BEAM ANTENNA SYSTEM

(75) Inventors: Joel C. Roper, Plano, TX (US); Kevin W. Ommodt, Allen, TX (US); James D. Hill, Rowlet, TX (US)

(73) Assignee: RAYTHEON COMPANY, Waltham, MA (US)

( * ) Notice: Subject to any disclaimer, the term of this patent is extended or adjusted under 35 U.S.C. 154(b) by 700 days.

(21) Appl. No.: 13/333,844

(22) Filed: Dec. 21, 2011

(65) Prior Publication Data

US 2013/0162478 A1 Jun. 27, 2013

(51) Int. Cl.

| | |
|---|---|
| ***H01Q 3/00*** | (2006.01) |
| ***H01Q 25/00*** | (2006.01) |
| ***H01Q 19/06*** | (2006.01) |
| *H01Q 3/26* | (2006.01) |

(52) U.S. Cl.
CPC ..... *H01Q 25/008* (2013.01); *H01Q 3/2658* (2013.01); *H01Q 19/062* (2013.01)

(58) Field of Classification Search
USPC ..... 342/373, 374, 377
See application file for complete search history.

(56) References Cited

U.S. PATENT DOCUMENTS

| | | | | |
|---|---|---|---|---|
| 4,186,398 | A | 1/1980 | Minnett et al. | |
| 5,128,687 | A | 7/1992 | Fay | |
| 5,936,588 | A | 8/1999 | Rao et al. | |
| 6,005,515 | A * | 12/1999 | Allen et al. | 342/374 |
| 6,052,086 | A | 4/2000 | Kudoh | |
| 6,275,184 | B1 | 8/2001 | Hemmi et al. | |
| 6,304,225 | B1 | 10/2001 | Hemmi | |
| 6,549,171 | B1 | 4/2003 | Mailloux | |
| 6,768,456 | B1 * | 7/2004 | Lalezari et al. | 342/373 |
| 7,071,872 | B2 | 7/2006 | Guy | |
| 7,119,733 | B2 | 10/2006 | Schoeberl et al. | |
| 7,171,158 | B2 * | 1/2007 | Rosen et al. | 455/12.1 |
| 7,206,608 | B1 | 4/2007 | Wu et al. | |
| 7,304,608 | B2 * | 12/2007 | Lin | 342/377 |
| 7,362,259 | B2 | 4/2008 | Gottwald | |
| 7,423,602 | B2 | 9/2008 | Lockie et al. | |
| 7,567,213 | B2 | 7/2009 | Liu | |
| 7,728,772 | B2 | 6/2010 | Mortazawi et al. | |
| 7,786,928 | B2 | 8/2010 | Hansen et al. | |
| 8,754,810 | B2 * | 6/2014 | Guo et al. | 342/368 |

(Continued)

FOREIGN PATENT DOCUMENTS

| | | |
|---|---|---|
| JP | 01-123505 | 5/1989 |
| JP | 10-93336 | 4/1998 |

(Continued)

OTHER PUBLICATIONS

Office Action mailed Feb. 4, 2013 for corresponding Japan Application No. 2012-232165, filed Oct. 19, 2012 (2 pgs.).
English language translation of Office Action mailed Feb. 4, 2013 for corresponding Japan Application No. 2012-232165, filed Oct. 19, 2012 (3 pgs.).

(Continued)

*Primary Examiner* — Harry Liu
(74) *Attorney, Agent, or Firm* — Christie, Parker & Hale, LLP

(57) ABSTRACT

A lens-based switched beam antenna system including a beam-forming lens, and a beam port router coupled to the beam-forming lens, including a plurality of beam ports, and configured to transmit beams via corresponding ones of the beam ports, wherein a first group of the beam ports corresponds to a first signal, and wherein a second group of the beam ports corresponds to a second signal.

13 Claims, 4 Drawing Sheets

(56) References Cited

U.S. PATENT DOCUMENTS

| | | | | |
|---|---|---|---|---|
| 2010/0073260 | A1 | 3/2010 | Fujita | |
| 2012/0062440 | A1 * | 3/2012 | Tasaki et al. | 343/841 |
| 2012/0146842 | A1 * | 6/2012 | Kang | 342/175 |

FOREIGN PATENT DOCUMENTS

| | | | |
|---|---|---|---|
| JP | 2010-74781 | | 4/2010 |
| JP | 2010-093563 | | 4/2010 |
| WO | WO 0139380 | A2 * | 5/2001 |

OTHER PUBLICATIONS

Lee, J. J. et al., "Multibearn Array Using Rotrnan Lens and RF Heterodyne", IEEE Antennas and Propagation Society International Symposium 1996 Digest, Jul. 21, 1996 (pp. 1612-1615).

Extended European Search Report for European Application No. 12188554.5, Filed Oct. 15, 2012, Extended European Search Report dated Apr. 23, 2013 and mailed May 3, 2013 (9 pgs.).

Examination Report for European Application No. 12188554.5, Filed Oct. 15, 2012. Examination Report mailed Jun. 4, 2014 (14 pgs.).

* cited by examiner

METHOD AND APPARATUS FOR DOUBLING THE CAPACITY OF A LENS-BASED SWITCHED BEAM ANTENNA SYSTEM

BACKGROUND

The present invention relates to the field of beam antenna systems.

Switched beam antenna systems utilizing RF lens devices (such as a Rotman lens or an Archer Lens) possess the ability to generate multiple simultaneous beams through the same lens. In some wide band multiple beam antenna systems, it is desired that many such beams be generated.

A typical switched beam antenna system utilizing an RF lens uses a plurality of beams to determine the directivity or shape of a far field signal corresponding to a signal produced by the antenna system. The system uses a plurality of switches to allow one or more beams corresponding to a signal to pass through corresponding beam ports, and beams that pass through respective beam ports then pass through a beam-forming lens to collectively shape the far field antenna signal. Once these beams pass through the beam-forming lens, they are able to illuminate antenna elements of the antenna array, which then produces a far field signal corresponding to the beams selected by the system.

A switched beam antenna system may also use a plurality of signals, wherein the signals are used to form various beams that are allowed to pass through corresponding beam ports of a beam port router as determined by the plurality of switches. The beams that pass through the beam port router then pass through the beam-forming lens and onto the antenna array, as described above. Accordingly, the combined plurality of signals are used to determine the directivity, shape, and strength of the far field signal produced by the switched beam antenna system.

However, when using a plurality of signals, additional components are required to effectively operate the switched beam antenna system. Such components include beam combiners/splitters. Such components may lead to undesired system loss, thereby requiring additional power to effectively operate the switched beam antenna system.

SUMMARY

Embodiments of the present invention provide a switched beam antenna system capable of utilizing a plurality of signals converted to a plurality of beams through a beam-forming lens without the use of beam combiners, thereby improving signal strength and reducing power loss.

One embodiment of the present invention provides a lens-based switched beam antenna system including a beam-forming lens, and a beam port router coupled to the beam-forming lens, including a plurality of beam ports, and configured to transmit beams via corresponding ones of the beam ports, wherein a first group of the beam ports corresponds to a first signal, and wherein a second group of the beam ports corresponds to a second signal.

The lens-based switched beam antenna system may further include a first switch matrix coupled to the beam port router and configured to transmit or receive a first subset of the beams corresponding to the first signal to or from selected ones of the first group of the beam ports, and a second switch matrix coupled to the beam port router and configured to transmit or receive a second subset of the beams corresponding to the second signal to or from selected ones of the second group of the beam ports.

The lens-based switched beam antenna system may further include an antenna array configured to form a far field beam corresponding to the beams transmitted from the beam port router to the beam-forming lens.

The lens-based switched beam antenna system may further include a processor for operating the first switch matrix and the second switch matrix corresponding to an angle or shape of the far field beam.

The lens-based switched beam antenna system may further include an antenna array configured to detect a far field signal in a far field and to transmit the beams corresponding to the far field signal to the beam port router via the beam-forming lens.

The first group of the beam ports may be even-numbered beam ports, and the second group of the beam ports may be odd-numbered beam ports.

Another embodiment of the present invention provides a lens-based switched beam antenna system including a plurality of switch matrices, each including a plurality of switches, and each for transmitting transmitted beams corresponding to a transmit signal, or for transmitting a receive signal corresponding to received beams, a beam port router coupled to the switch matrices, including a plurality of beam ports corresponding to respective ones of the plurality of switches, and configured to transmit the transmitted beams or received beams, a beam-forming lens configured to transmit the received beams to, or receive the transmitted beams from, the beam port router, and an antenna array configured to be illuminated by the transmitted beams passing through the beam-forming lens to form a far field beam, or configured to transmit the received beams to the beam-forming lens corresponding to a detected far field signal.

The transmitted beams may include a plurality of beam sets each corresponding to respective ones of the transmit signals.

The beam ports may include a plurality of groups, each group corresponding to a corresponding one of the beam sets.

The lens-based switched beam antenna system may further include a processor for operating the plurality of switches.

The processor may be configured to operate the plurality of switches corresponding to an angle of the far field beam.

The lens-based switched beam antenna system may further include a lookup table for mapping angles of the far field beam corresponding to operation of the plurality of switches.

The processor may be configured to analyze one or more receive signals to estimate at least one of a location and a strength of the detected far field signal.

The antenna array may include a plurality of antenna elements for transmitting the received beams to selected ones of the beam ports via the beam-forming lens corresponding to the detected far field signal.

The antenna elements may each correspond to one or more of the beam ports, and may be respectively illuminated by the transmitted beams passing through the corresponding beam ports.

Yet another embodiment of the present invention provides a method for doubling the capacity of a lens-based switched beam antenna system, the method including processing a plurality of signals, delivering each of the plurality of signals to corresponding switch matrices, determining a desired far field beam angle corresponding to the plurality of signals, operating switches of the switch matrices according to the desired far field beam angle, passing one or more beams corresponding to the plurality of signals through open ones of the switches into a beam port router, passing the one or more beams into a beam-forming lens, and illuminating an antenna array with the one or more beams from the beam-forming lens to produce a far field beam corresponding to the desired far field beam angle.

Accordingly, embodiments of the present invention provide a switched beam antenna system of increased capacity by utilizing a plurality of signals and by devoting groups of beam ports of a beam port router to beams of corresponding ones of the plurality of signals.

BRIEF DESCRIPTION OF THE DRAWINGS

The accompanying drawings, together with the specification, illustrate exemplary embodiments of the present invention, and, together with the description, serve to explain aspects of embodiments of the present invention. The above and other features and aspects of the present invention will become more apparent by describing in detail exemplary embodiments thereof with reference to the attached drawings, in which.

DETAILED DESCRIPTION

Embodiments of the present invention provide a lens-based switched beam antenna system capable of inserting multiple signals into a common antenna beamformer while minimizing insertion loss and complexity.

Figure 1:
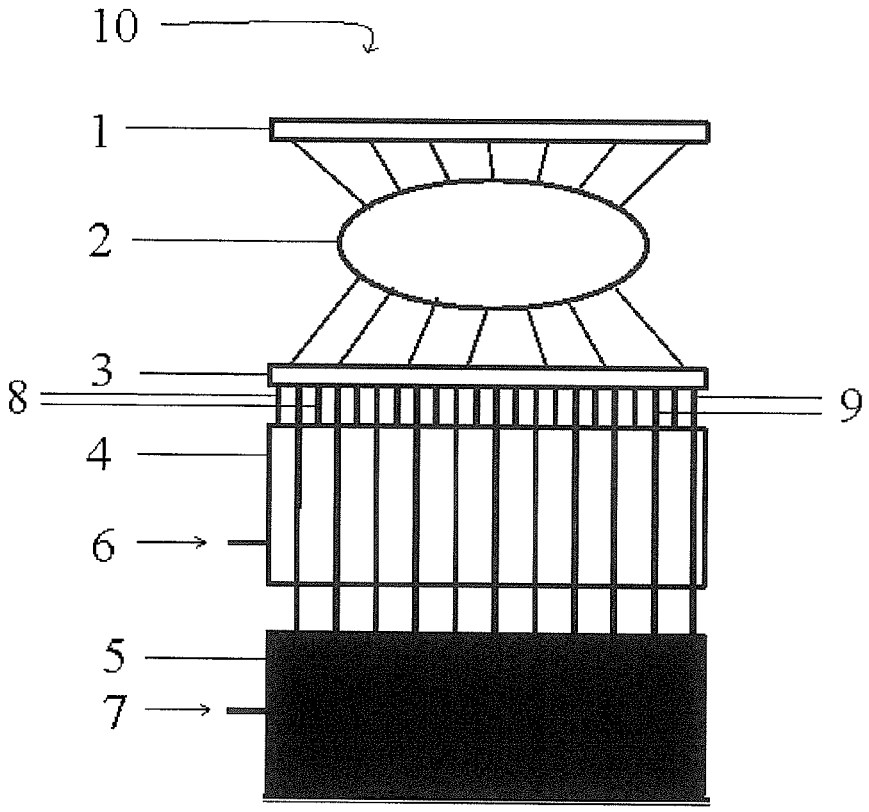
FIG. 1 is a schematic diagram of a switched beam antenna system according to an embodiment of the present invention.

Referring to FIG. 1, a lens-based switched beam antenna system 10 according to an embodiment of the present invention is shown. The lens-based switched beam antenna system 10 includes an antenna array 1 that is coupled to a beam-forming lens 2, which is coupled to a beam port router 3. The beam port router 3 of the present embodiment is coupled to a first switch matrix 4 and a second switch matrix 5, wherein the first switch matrix 4 corresponds to odd beam ports 8 of the beam port router 3, and the second switch matrix 5 corresponds to even beam ports 9 of the beam port router 3.

Accordingly, a first signal 6 for producing a first beam set may be transmitted to the first switch matrix 4, and a second signal 7 for producing a second beam set may be transmitted to the second switch matrix 5. The first switch matrix 4 and the second switch matrix 5 may each be a 2 X (1:N/2) switch matrix, where N is equal to the total number of beam ports of the beam port router 3. By relegating the first beam set from the first switch matrix 4 to the odd beam ports 8 of the beam port router 3, and relegating the second beam set from the second switch matrix 5 to the even beam ports 9 of the beam port router 3, the use of the switch matrices 4, 5 obviates the need for either beam combiners or beam splitters/dividers, thereby increasing the capacity of the system 10. By utilizing two switch matrices 4, 5, a plurality of beams corresponding to two different signals 6, 7 may be sent to the beam port router 3, with each of the switch matrices 4, 5 transmitting a corresponding one of the signals 6, 7 through a plurality of switches as one or more of the beams. Accordingly, the one or more beams transmitted by the switch matrices 4, 5 pass through the beam-forming lens 2 and collectively form a beam in the far field. According to embodiments of the present invention, the switches of the switch matrices 4, 5 may be microelectromechanical system switches (MEMS). For reference purposes, beam forming networks utilizing MEMS switches as well as "Butler matrices" are shown in U.S. Pat. No. 7,567,213 B2 (e.g., see FIGS. 7 and 8, and col. 4, ln. 56 to col. 5, ln. 16).

Figure 2:
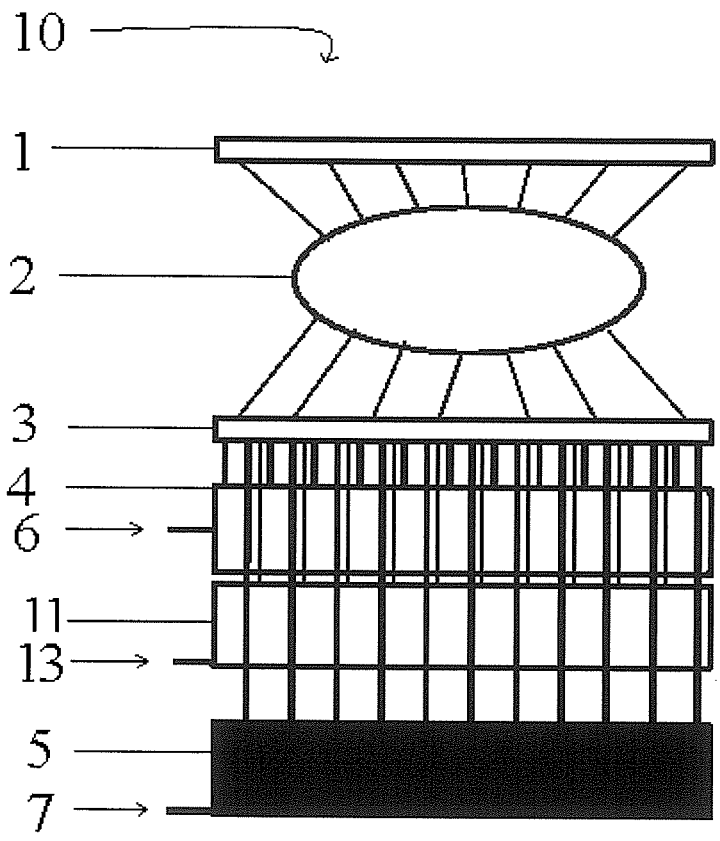
FIG. 2 is a schematic diagram of a switched beam antenna system according to another embodiment of the present invention.

Although the lens-based switched beam antenna system 10 according to the present embodiment depicts two switch matrices 4, 5, other embodiments of the present invention utilizing three or more switch matrices may be used with a corresponding number of signals/beam sets. For example, see FIG. 2, which demonstrates a third switch matrix 11 for receiving a third signal 13. However, an increase in the number of switch matrices leads to a corresponding increase in cross-over loss of the different signals (e.g., 6, 7, 13) at the beam-forming lens 2, cross-over loss being discussed further below.

Furthermore, although the present embodiment is discussed with respect to transceiver-operated antenna system 10, embodiments of the present invention may also be applied to receiving antenna systems, as well as bi-directional antenna systems, as will be known to one of ordinary skill in the art.

The beam-forming lens 2 of embodiments of the present invention may be an optic lens, such as, for example, a Rotman lens or an Archer lens. Uses of a Rotman lens for the purpose of beam steering may be found, for example, in U.S. Pat. No. 7,423,602 B2 (e.g., FIG. 24 and the corresponding description at col. 5, lns 31-40 depict a rotating Rotman lens used to provide elevation steering), and in U.S. Pat. No. 6,275,184 B1 (e.g., FIGS. 3 and 4 and the corresponding description at col. 5, lns 21-64 describe using switches and a Rotman lens for beam shaping). Furthermore, the detailed description of U.S. Pat. No. 7,119,733 B2 describes a beam-shaping network utilizing a switching network and a lens such as a Butler matrix and a Rotman lens at col. 2, ln 34 to col. 3 ln. 13. U.S. Pat. No. 7,119,733 B2 further describes using a single transmission signal that is sent to the switching network, and that the operation of the switches of the switching network (i.e., selection of the inputs) determines the directivity characteristic in the transmission direction (i.e., the directivity of the beam formed in the far field).

Each individual beam corresponding to one of the switch matrices 4, 5 and passing through a corresponding beam port of the beam port router 3 has a particular path from the beam port router 3, through the beam-forming lens 2, and to the antenna array 1 according to the properties and configuration of the system 10. By exciting a portion of the lens 2 on a side closest to the beam port router 3 using a given beam, the beam radiates through the lens 2, and then illuminates one or more antenna elements of the antenna array 1. For example, numerous beams exiting the beam port router 3 and passing through the beam-forming lens 2 may illuminate, to different degrees, each element of the antenna array 1. Therefore, numerous beams passing through the beam port router 3 will combine to form a beam in the far field. Accordingly, the configuration of the system along with the selection of the switches of the switch matrices 4, 5 that allow input of a corresponding signal 6, 7 will determine directivity and shape characteristics of the beam formed in the far field.

Similarly, according to embodiments of the present invention, a far field signal detected by the antenna array 1 may be passed along via various antenna elements as one or more beams to the beam-forming lens 2, to then be passed along to corresponding beam ports of the beam port router 3 and interpreted as signals 6, 7 passing through the switch matrices 4, 5. These signals may then be analyzed by a processor 12 of the system (see FIG. 3) to estimate the location and strength of the detected far field signal.

Figure 3:
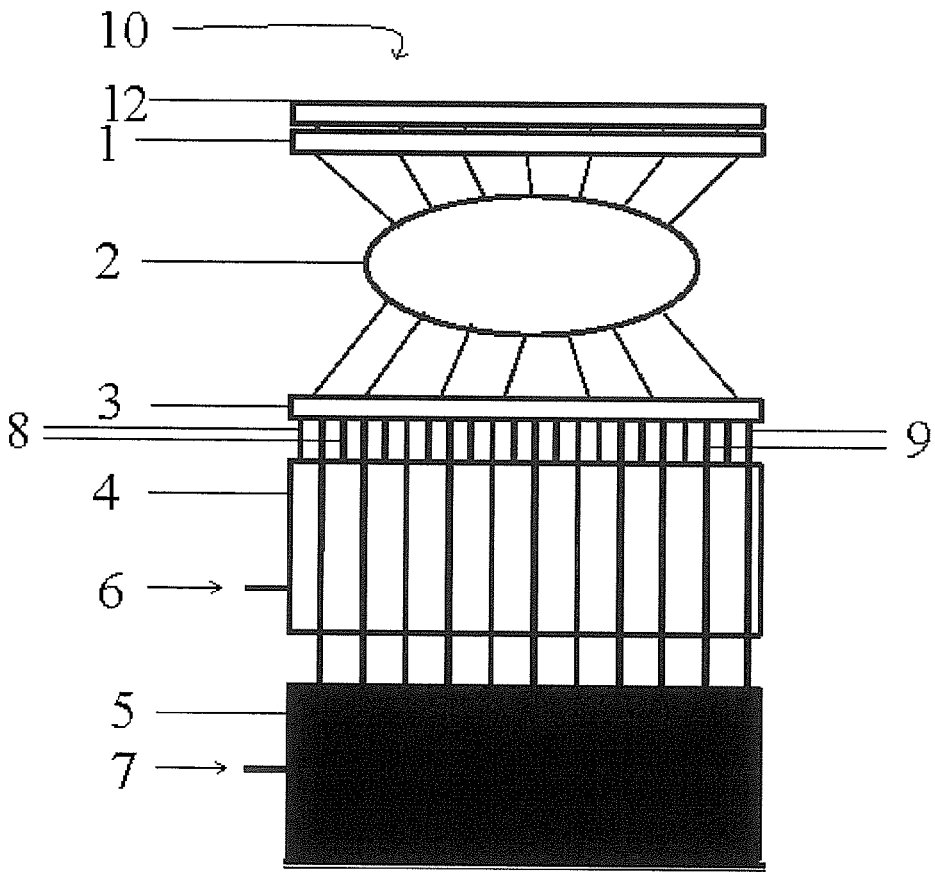
FIG. 3 is a schematic diagram of a switched beam antenna system according to yet another embodiment of the present invention.

Depending on the configuration of the system 10, information corresponding to a far field signal may take different amounts of time to reach different elements of the antenna array 1. This is due to the fact that different antenna elements of the array 1 may have different distances from the far field signal. Accordingly, the lens-based switched beam antenna system 10 of embodiments of the present invention is capable of determining phase differences by, for example, using a phase calculator/processor 12 to conduct digital signal processing of the signals received by the antenna elements of the array 1. Such signal analysis will be appreciated by one of ordinary skill in the art, and is schematically shown in FIG. 3, whereby the phase calculator/processor 12 is electrically coupled to the antenna array 1 to analyze the characteristics individually measured by one or more of the elements of the antenna array 1. The analysis of the phase of different beam signals corresponds to the distance traveled by these different beam signals, and therefore also corresponds to the location of the far field signal.

Accordingly, different phases of beams of different signals cause a beam to form in the far field. The beam formed in the far field may be shaped, or tilted, depending on a degree of phase delay according to standard phased array principles, which will be understood by one of ordinary skill in the art. Therefore, the switch matrices 4, 5 according to embodiments of the present invention may selectively open or close switches corresponding to the beam ports of the beam port router 3 to allow beams of the beam sets corresponding to the signals 6, 7 to pass through the lens 2 to thereby determine characteristics, such as directivity and strength, of a beam formed in the far field. Similar to the manner in which a magnifying glass may focus or scatter beams of light passing therethrough, the manner of shaping and directing a far field beam emitted by the lens 2 will be in accordance with optical principles of physics, and will depend upon the material, shape, and focal point(s) of the lens 2, as well as the location and positioning of the beam ports of the beam port router 3 with respect to the lens 2.

Furthermore, and for example, the double convex structure of the lens 2 according to the present embodiment, and as shown in FIG. 1, causes a beam received from the beam port router 3 on a left side of the lens 2 to result in a corresponding beam emitted by the lens 2 and causing the signal formed in the far field to be steered to the right. However, beams emitted by the beam port router 3 at a center of the lens 2 of embodiments of the present invention, and having a trajectory that is perpendicular to the plane of the lens 2, will ideally pass through the focal point of the lens with little bending of the beam(s), and the general direction of the beams corresponding to a main lobe portion of the far field beam that is emitted by the lens 2 will also be perpendicular to the plane of the lens 2 (e.g., see FIG. 4*b*). Accordingly, by operating the switches in the switch matrices 4, 5, a desired far field beam may be formed using the inputted signals 6, 7.

For example, FIG. 4*a* demonstrates how a hypothetical lens 2 may produce a beam in the far field having a main lobe that is steered to the left by operating the switch matrices 4, 5 to effectively prevent beams from passing through some or all of the beam ports on the left side of the beam port router 3 while allowing a beam or beams to pass through one or more beam ports on the right side of the beam port router 3. Similarly, FIG. 4*c* shows a situation in which the switch operation of the switch matrices 4, 5, mirrors the hypothetical switch operation corresponding to FIG. 4*a*. Furthermore, FIG. 4*b* depicts a situation in which the operation of the switches is symmetrical with respect to the center of the lens 2 (e.g., the switches corresponding to the beam ports located closest to the center of the lens 2 are open, while the rest of the switches are closed).

Figure 4:
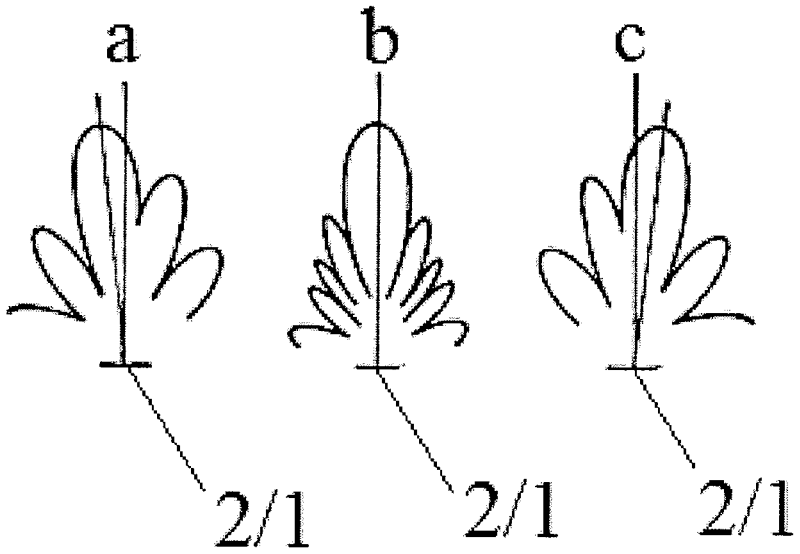
FIG. 4 is a representative depiction of hypothetical beams in the far field corresponding to different switch configurations and formed by a switched beam antenna system of an embodiment of the present invention.

It should be understood that the depictions and descriptions of the hypothetical beams in FIG. 4 are merely for illustrative purposes, and the shapes and directions of beams produced by systems 10 of embodiments of the present invention are virtually unlimited, and the shape and directivity of actual far field beams will be determined by the design of the system 10, selection of the signals (e.g., 6, 7), and operation of the switch matrices (e.g., 4, 5) according to embodiments of the present invention.

Embodiments of the present invention enable the lens-based switched beam antenna system 10 to determine a desired beam angle of the beam in the far field, and to map various beam angles to a particular port, or plurality of ports, by operating the switch matrices 4, 5. For example, as mentioned above, for desired far field beams having an angle aimed rightwardly, at least some of the switches of the switch matrices 4, 5 corresponding to the ports of the beam port router 3 on the left side are operated to allow the desired beams of the beam sets to pass through, while at least some of the switches corresponding to the right side are operated to be closed to prevent the unwanted beams of the beam sets from passing through. The various beam angles may be mapped or approximated using a processor 12 (see FIG. 3) and inputted algorithms, or by storing switch profiles corresponding to approximated beam angles into a memory or lookup table.

For example, during the design of a system 10 of an embodiment of the present invention, laboratory tests may be performed using a prototype or computer model by delivering the first signal 6 to the first switch matrix 4, and the second signal 7 to the second switch matrix 5, and thereafter measuring each of the various beams produced in the far field by the lens 2 by varying the operation of the switch matrices 4, 5 (e.g., measuring each beam that results from each of the various combinations of open-closed configurations of the switches of the switch matrices 4, 5). This process may then be repeated for varying signals 6, 7 intended to be used with the system 10. Once the characteristics of the various signals/various switch configurations and the corresponding various far field beams are measured, the results may be stored in the memory/lookup table in the processor 12 of the system 10.

Accordingly, an operator of the system 10 of the present embodiment may access the memory/lookup table to find a beam angle and shape that most closely approximates a desired beam angle and shape, and then (from the information stored in the memory/lookup table) determine the corresponding signal 6, 7 characteristics and switch configurations of the switch matrices 4, 5 to enable the operator to reproduce the previously analyzed beam angle and shape to approximately produce the desired far field beam.

According to the present embodiment, the beams resulting from the signals 6, 7 are scanned in a particular direction, ensuring that no beams of different signals 6, 7 ever occupy the same port of the beam port router 3. A control device of the system 10, such as a processor 12, is then able to independently control the switches of the switch matrices 4, 5 to effectively allow desired beams corresponding to the signals 6, 7 to pass through selected ports of the beam port router 3 to shape or approximate a desired far field beam angle. This determination of which switches to operate to achieve far field beams that approximate or achieve particular angles may be made by mapping the different ports as described above (e.g., running experiments to determine which beam ports of the beam port router 3 correspond to a particular angle, and storing the results of the experiments in a look up table of the system 10 that may be accessed by the processor 12 to enable effective control of the corresponding switches of the switch matrices 4, 5). Because a finite number of ports/switches are used, only a finite number of differing beam angles of any given system may be achieved. Furthermore, a decrease in the number of switches/beam ports will result in a decrease in the number of reproducible distinct far field beam shapes and directions. Accordingly, it may be necessary to allow operation of the switches so that a beam passes through a port resulting in the formation of a far field beam that most closely represents the desired beam angle, even if the actual angle of the far field beam does not exactly match the desired beam angle.

Utilizing a wide band lens beamformer 10 possessing many beam ports (for example, a Rotman or Archer Leris possessing 64 beam ports) according to embodiments of the present invention, the capacity of the lens 2 may be effectively doubled by using odd-numbered beam ports (e.g., 1, 3, 5, . . . 63) for a first beam set corresponding to the first signal 4, and by using even-numbered beam ports (e.g., 2, 4, 6, . . . 64) for a second beam set corresponding to the second signals 5.

Due to the nature of the wideband lens 2, the odd and even beams are practically indistinguishable from each other for the lower portions of the band (e.g., the lower two-thirds of the band). At the higher end of the band, the odd and even beams become more distinct, due to the narrower beamwidths. This phenomenon may be referred to as "cross-over loss," and can typically be compensated for by design of the other components and operations of the lens-based switched beam antenna system 10.

While the present invention has been particularly shown and described with reference to exemplary embodiments thereof, it will be understood by those of ordinary skill in the art that features of different embodiments may be combined to form further embodiments, and that various changes in form and details may be made therein, without departing from the spirit and scope of the present invention as defined by the following claims, and their equivalents.

What is claimed is:

1. A lens-based switched beam antenna system comprising:

a plurality of antenna elements for receiving and transmitting beams;

a beam-forming lens coupled to the plurality of antenna elements;

a beam port router coupled to the beam-forming lens and comprising a plurality of beam ports to transmit beams to and receive beams from the plurality of antenna elements, via corresponding ones of the beam ports;

a first switch matrix directly coupled to even numbered beam ports of the beam port router to transmit and receive, without a beam combiner and without a beam splitter, a first signal corresponding to a first beam set; and a second switch matrix directly coupled to odd numbered beam ports of the beam port router to transmit and receive, without a beam combiner and without a beam splitter, a second signal different from the first signal and corresponding to a second beam set different from the first beam set.

2. The lens-based switched beam antenna system of claim 1, further comprising an antenna array configured to form a far field beam corresponding to the beams transmitted from the beam port router to the beam-forming lens.

3. The lens-based switched beam antenna system of claim 2, further comprising a processor for operating the first switch matrix and the second switch matrix corresponding to an angle or shape of the far field beam.

4. The lens-based switched beam antenna system of claim 1, further comprising an antenna array configured to detect a far field signal in a far field and to transmit the beams corresponding to the far field signal to the beam port router via the beam-forming lens.

5. A lens-based switched beam antenna system comprising:

a plurality of switch matrices, each comprising a plurality of switches, and each for transmitting transmitted beams corresponding to a transmit signal, and for transmitting a receive signal corresponding to received beams, without a beam combiner and without a beam splitter;

a beam port router coupled to the switch matrices, comprising a plurality of beam ports corresponding to respective ones of the plurality of switches, and configured to transmit the transmitted beams and received beams;

a beam-forming lens coupled to the beam port router to transmit the received beams to, and receive the transmitted beams from, the beam port router; and an antenna array configured to be illuminated by the transmitted beams passing through the beam-forming lens to form a far field beam, and configured to transmit the received beams to the beam-forming lens corresponding to a detected far field signal, wherein the transmitted beams comprise a plurality of beam sets each corresponding to respective ones of the transmit signals.

6. The lens-based switched beam antenna system of claim 5, wherein the beam ports comprise a plurality of groups, each group corresponding to a corresponding one of the beam sets.

7. The lens-based switched beam antenna system of claim 5, further comprising a processor for operating the plurality of switches.

8. The lens-based switched beam antenna system of claim 7, wherein the processor is configured to operate the plurality of switches corresponding to an angle of the far field beam.

9. The lens-based switched beam antenna system of claim 7, further comprising a lookup table for mapping angles of the far field beam corresponding to operation of the plurality of switches.

10. The lens-based switched beam antenna system of claim 7, wherein the processor is configured to analyze one or more receive signals to estimate at least one of a location and a strength of the detected far field signal.

11. The lens-based switched beam antenna system of claim 5, wherein the antenna array comprises a plurality of antenna elements for transmitting the received beams to selected ones of the beam ports via the beam-forming lens corresponding to the detected far field signal.

12. The lens-based switched beam antenna system of claim 11, wherein the antenna elements each correspond to one or more of the beam ports, and are respectively illuminated by the transmitted beams passing through the corresponding beam ports.

13. A method for doubling a capacity of a lens-based switched beam antenna system, the method comprising:

processing a plurality of signals, each signal for producing a corresponding beam set;

delivering each of the plurality of signals to a corresponding switch matrix of a plurality of switch matrices, wherein each of the plurality of switch matrices is without a beam combiner and without a beam splitter;

determining a desired far field beam angle corresponding to the plurality of signals;

operating switches of the switch matrices according to the desired far field beam angle;

directly passing one or more beams corresponding to the plurality of signals through open ones of the switches into a beam port router;

directly passing the one or more beams from the beam port router into a beam-forming lens; and illuminating an antenna array with the one or more beams from the beam-forming lens to produce a far field beam corresponding to the desired far field beam angle.

* * * * *